US010730045B2

(12) United States Patent
Hung et al.

(10) Patent No.: US 10,730,045 B2
(45) **Date of Patent: *Aug. 4, 2020**

(54) SYSTEM AND METHOD FOR PERFORMING DROPLET INFLATION

(71) Applicant: Bio-Rad Laboratories, Inc., Hercules, CA (US)

(72) Inventors: Tony Hung, Cambridge, MA (US); Adnan Esmail, Boston, MA (US); Sepehr Kiani, Cambridge, MA (US)

(73) Assignee: Bio-Rad Laboratories, Inc., Hercules, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/196,337

(22) Filed: Nov. 20, 2018

(65) Prior Publication Data

US 2019/0091685 A1 Mar. 28, 2019

Related U.S. Application Data

(63) Continuation of application No. 15/410,913, filed on Jan. 20, 2017, now Pat. No. 10,159,977, which is a (Continued)

(51) Int. Cl.
*B01L 3/00* (2006.01)

(52) U.S. Cl.
CPC ... *B01L 3/502715* (2013.01); *B01L 3/502784* (2013.01); *B01L 2200/06* (2013.01); (Continued)

(58) Field of Classification Search
CPC .... B01L 3/00; B01L 3/502715; B01L 3/5027; B01L 3/502; B01L 3/50
(Continued)

(56) References Cited

U.S. PATENT DOCUMENTS 8,528,589 B2 9/2013 Miller et al.
8,535,889 B2 9/2013 Larson et al.
(Continued)

FOREIGN PATENT DOCUMENTS

EP 2364774 A2 9/2011
EP 2662135 A2 11/2013
(Continued)

OTHER PUBLICATIONS

European Patent Application 18211262.3; Extended European Search Report dated Jan. 24, 2019; 6 pages.
(Continued)

*Primary Examiner* — Christine T Mui
(74) *Attorney, Agent, or Firm* — Kilpatrick Townsend and Stockton LLP

(57) ABSTRACT

The present invention generally pertains to a system for performing droplet inflation, and methods and kits comprising the same. The system comprises at least one microfluidic channel comprising one or more droplets flowing therein, one or more fluid reservoirs, one or more inflators, one or more inflator nozzles, and at least one mechanism for disrupting an interface between a droplet and a fluid. The present invention provides for the inflation of a relatively controlled volume of fluid into a droplet resulting in an increase in the volume of the droplet relative to its volume prior to inflation and, accordingly, dilution of the concentration of species, if any, previously present and emulsified in the droplet.

11 Claims, 9 Drawing Sheets

Related U.S. Application Data continuation of application No. 14/762,617, filed as application No. PCT/US2014/013198 on Jan. 27, 2014, now Pat. No. 9,592,503.

(60) Provisional application No. 61/756,598, filed on Jan. 25, 2013.

(52) U.S. Cl.
CPC ..... *B01L 2200/0605* (2013.01); *B01L 2300/0645* (2013.01); *B01L 2300/087* (2013.01); *B01L 2300/0816* (2013.01); *B01L 2300/0861* (2013.01); *B01L 2300/0864* (2013.01); *B01L 2300/0867* (2013.01); *B01L 2300/161* (2013.01); *B01L 2300/1861* (2013.01); *B01L 2400/0415* (2013.01); *B01L 2400/0448* (2013.01); *B01L 2400/0487* (2013.01)

(58) Field of Classification Search
USPC ..... 422/50, 500, 502; 436/180
See application file for complete search history.

(56) References Cited

U.S. PATENT DOCUMENTS

| | | | | |
|---|---|---|---|---|
| 2003/0015425 | A1 | 1/2003 | Bohm et al. | |
| 2003/0124509 | A1* | 7/2003 | Kenis | B01F 13/0062 435/4 |
| 2007/0227591 | A1 | 10/2007 | Wissink et al. | |
| 2009/0129980 | A1 | 5/2009 | Lawson et al. | |
| 2011/0151578 | A1 | 6/2011 | Abate et al. | |
| 2011/0218123 | A1 | 9/2011 | Weitz et al. | |
| 2011/0250597 | A1 | 10/2011 | Larson et al. | |
| 2011/0267457 | A1 | 11/2011 | Weitz et al. | |
| 2012/0015822 | A1 | 1/2012 | Weitz et al. | |
| 2012/0132288 | A1 | 5/2012 | Weitz et al. | |
| 2012/0219947 | A1 | 8/2012 | Yurkovetsky et al. | |
| 2012/0220494 | A1 | 8/2012 | Samuels et al. | |
| 2012/0222748 | A1 | 9/2012 | Weitz et al. | |
| 2012/0309002 | A1 | 12/2012 | Link | |
| 2014/0354795 | A1 | 12/2014 | Tracy et al. | |
| 2015/0024945 | A1 | 1/2015 | Healy | |
| 2015/0065396 | A1 | 3/2015 | Kiani et al. | |
| 2015/0093815 | A1 | 4/2015 | Kiani et al. | |

FOREIGN PATENT DOCUMENTS

| | | | | |
|---|---|---|---|---|
| WO | 2004/103565 | A2 | 12/2004 | |
| WO | 2007/081385 | A2 | 7/2007 | |
| WO | 2007/081387 | A1 | 7/2007 | |
| WO | 2010/151776 | A2 | 12/2010 | |
| WO | 2012/078710 | A1 | 6/2012 | |
| WO | 2012/135201 | A1 | 10/2012 | |
| WO | 2012/135259 | A1 | 10/2012 | |
| WO | 2012/135327 | A1 | 10/2012 | |
| WO | WO 2012/162296 | A2 * | 11/2012 | B01F 13/00 |
| WO | 2013/095737 | | 6/2013 | |
| WO | 2013/122826 | A1 | 8/2013 | |
| WO | 2013/165748 | A1 | 11/2013 | |
| WO | 2014/043388 | A1 | 3/2014 | |
| WO | 2014/093976 | A1 | 6/2014 | |
| WO | 2014/176599 | A1 | 10/2014 | |

OTHER PUBLICATIONS

Abate et al., "High-throughput injection with microfluidics using picoinjectors," *Proc. Natl. Acad. Sci. USA*. 107(45):19163-19166 (2010) ePub Oct. 20, 2010.

Xu et al., "Droplet coalescence in mirofluidic systems," *Micro and Nanosystems*; 3:131-136 (2011).

The International Search Report from PCT/US2014/013198, dated May 16, 2014 (2 pages).

European Search Report from EPO Application No. 14743656.2; dated Aug. 19, 2016.

* cited by examiner

Microfluidic Device 100

Microfluidic Device 220

Microfluidic Device 240, SECTION 125A

Microfluidic Device 260, SECTION 125B

Microfluidic Device 280, SECTION 125C

Microfluidic Device 140

Microfluidic Device 200

SYSTEM AND METHOD FOR PERFORMING DROPLET INFLATION

CROSS-REFERENCES TO RELATED APPLICATIONS

The present application is a continuation application of U.S. patent application Ser. No. 15/410,913, filed Jan. 20, 2017, which is a continuation application of U.S. patent application Ser. No. 14/762,617, filed Jul. 22, 2015, now U.S. Pat. No. 9,592,503 issued Mar. 14, 2017, which is a national phase application under 35 U.S.C. § 371 of PCT/US2014/013198, filed Jan. 27, 2014, which claims priority to U.S. Provisional Application No. 61/756,598, filed Jan. 25, 2013.

The foregoing applications, and all documents cited therein or during its prosecution ("appln cited documents") and all documents cited or referenced in the appln cited documents, and all documents cited or referenced herein ("herein cited documents"), and all documents cited or referenced in herein cited documents, together with any manufacturer's instructions, descriptions, product specifications, and product sheets for any products mentioned herein or in any document incorporated by reference herein, are hereby incorporated herein by reference, and may be employed in the practice of the invention. More specifically, all referenced documents are incorporated by reference to the same extent as if each individual document was specifically and individually indicated to be incorporated by reference.

FIELD OF THE INVENTION

The present invention is in the technical field of microfluidics. More particularly, the present invention relates to a microfluidic device for increasing droplet volume.

BACKGROUND OF THE INVENTION

Microfluidic processes may use droplets as reaction vessels for performing chemical or biological reactions. In such processes, often referred to as droplet microfluidics, it may be desirable to increase the volume of the droplet by introducing additional fluid into the droplet. This ability allows significant dilution of the contents of a droplet, which may be desirable for controlling the concentration of substances within a droplet and enabling further partitioning or division of the contents of one droplet into multiple droplets for ease of handling or detection.

For example, to perform a simple enzymatic assay in one or more droplets, enzyme molecules and enzyme substrate may be introduced into the droplet by injection, followed by incubation and, typically, an optical detection step. In some cases, it may be desirable for the initial droplets to be divided into many droplets. In these instances, the initial droplet size may be too small, such that when the droplet is divided, the volume of the resulting droplets is insufficient for the remaining processes.

One solution to this is to increase the size of the droplet by adding picoliter size volumes of liquid to the droplets using, for example, picoinjection (e.g., Abate et al., "High-throughput injection with microfluidics using picoinjectors", *PNAS* (2010), vol. 107, pp. 19163-19166. However, a significant challenge with picoinjection is that it is difficult to increase the size of the droplet to more than twice its initial volume. In another example—droplet merger—requires the formation of droplets much larger than the initial droplets to be synchronized with the injection of the initial droplets, which is a technically challenging procedure. While picoinjection solves the synchronization problem, it is not capable of increasing droplet volume to more than twice its initial volume. Accordingly, there is a need for an affordable and efficient system, method and kit for increasing the volume of a droplet by many times its initial volume to improve the performance and applicability of droplet-based microfluidics.

The following invention provides a system, method and kit for increasing the volume (and hence, size) of a droplet relative to the initial volume of the droplet, resulting in improved performance and applicability of droplet-based microfluidics.

Citation or identification of any document in this application is not an admission that such document is available as prior art to the present invention.

BRIEF SUMMARY OF THE INVENTION

The present invention generally pertains to a system for performing droplet inflation. One embodiment of the system of the present invention pertains to a microfluidic device for performing droplet inflation, wherein the volume of a droplet is increased to greater than its initial volume, thereby diluting the concentration of species, if any, present and emulsified in the droplet. The microfluidic device may comprise at least one microfluidic channel through which droplets flow. The microfluidic device may further comprise at least one fluid reservoir comprising a fluid for inflation ("inflation fluid") of the droplets flowing through one or more microfluidic channels. Each of the at least one fluid reservoir may further comprise at least one inflator, wherein each inflator may comprise one or more inflator nozzle, wherein each inflator nozzle may interface with a microfluidic channel at a region referred to as an "inflation interface." The fluid reservoir may further comprise a series of in-line inflators, wherein each inflator may comprise one or more inflator nozzle, wherein each inflator nozzle may interface with the microfluidic channel at a respective inflation interface. The microfluidic device may further comprise a mechanism for disrupting at least a portion of the interface between a droplet flowing in a microfluidic channel and a fluid in an inflator, resulting in inflation of a relatively controlled volume of fluid into the droplet and, hence, an increase in the volume of the droplet relative to its volume prior to inflation.

The present invention also pertains to a method for performing droplet inflation comprising a microfluidic device, as described previously and further herein.

The present invention also pertains to a kit comprising a microfluidic device and reagents for performing droplet inflation, as described previously and further herein.

Accordingly, it is an object of the invention to not encompass within the invention any previously known product, process of making the product, or method of using the product such that Applicants reserve the right and hereby disclose a disclaimer of any previously known product, process, or method. It is further noted that the invention does not intend to encompass within the scope of the invention any product, process, or making of the product or method of using the product, which does not meet the written description and enablement requirements of the USPTO (35 U.S.C. § 112, first paragraph) or the EPO (Article 83 of the EPC), such that Applicants reserve the right and hereby disclose a disclaimer of any previously described product, process of making the product, or method of using the product.

It is noted that in this disclosure and particularly in the claims and/or paragraphs, terms such as "comprises", "comprised", "comprising" and the like can have the meaning attributed to it in U.S. Patent law; e.g., they can mean "includes", "included", "including", and the like; and that terms such as "consisting essentially of" and "consists essentially of" have the meaning ascribed to them in U.S. Patent law, e.g., they allow for elements not explicitly recited, but exclude elements that are found in the prior art or that affect a basic or novel characteristic of the invention.

These and other embodiments are disclosed or are obvious from and encompassed by, the following Detailed Description.

BRIEF DESCRIPTION OF THE DRAWINGS

The following detailed description, given by way of example, but not intended to limit the invention solely to the specific embodiments described, may best be understood in conjunction with the accompanying drawings.

DETAILED DESCRIPTION OF THE INVENTION

Figure 1A:
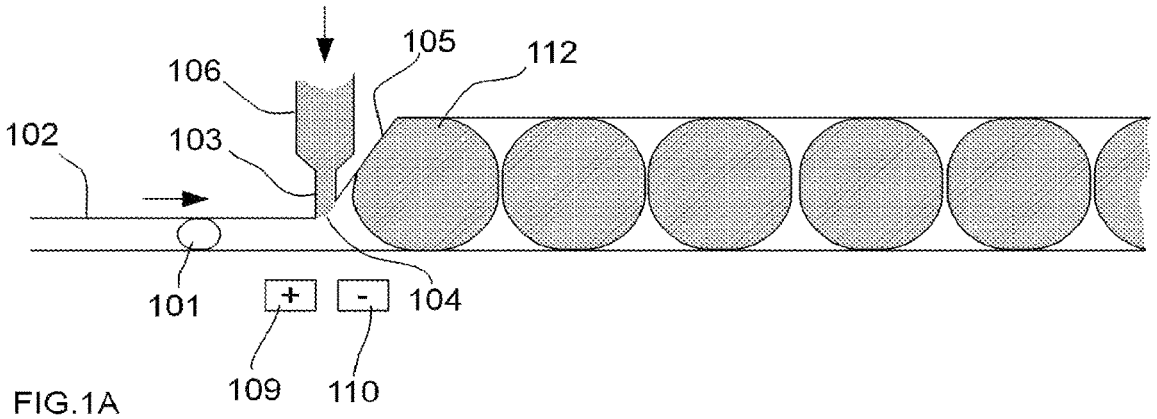
FIGS. 1A-B illustrate an example of an embodiment of a microfluidic device for performing droplet inflation comprising a single pair of electrodes and an inflator comprising a single inflator nozzle, according to the present invention.

The present invention generally pertains to a microfluidic device for performing droplet inflation, wherein the volume of a droplet is increased relative to its initial volume. A "microfluidic device", as used herein, is a device that enables a means of effecting a deterministic function on liquid or gas fluids at small scales typically measured in volumes such as, for example, milliliter (mL), microliter (μL), nanoliter (nL), picoliter (pL), or femtoliter (fL) volumes and/or by physical scale such as millimeter (mm), micrometer (μm), or nanometer (nm). Functions may include mixing, splitting, sorting, heating, and so forth. Microfluidic devices may comprise one or more microfluidic channels as a means for transferring droplets, fluids and/or emulsions from one point to another point and are typically of uniform cross section in the mm, μm or nm scale.

In one embodiment of the present invention, the microfluidic device comprises at least one microfluidic channel through which droplets flow. A "droplet", as used herein, means an isolated hydrophilic or hydrophobic phase within a continuous phase having any shape, for example but not limited to, cylindrical, spherical and ellipsoidal, as well as flattened, stretched or irregular shapes and so on. One or more droplets produced according to the present invention may be used to perform various functions, including but not limited to, serving as reaction vessels for performing chemical reactions; collectively encompassing a library of elements, including but not limited to a library of oligonucleotide probes; or as lenses for focusing a laser for optical applications.

The droplets flow through a microfluidic channel by being acted upon by a source of positive or negative pressure, e.g., a pressurized or evacuated air reservoir, syringe pump, gravity or centripetal forces, wherein the pressure source comprises any fluid or combinations of fluids, including but not limited to, any gas or combination of gases (e.g., air, nitrogen, carbon dioxide, argon, and so forth) or any liquid or combinations of liquids (e.g., water, buffer, oil, and so forth), such that the droplets flow or stream through a microfluidic channel and are herein referred to as "flowing droplets" or "streaming droplets." The size (or diameter) of a microfluidic channel is sufficiently narrow such that the droplets flow through a microfluidic channel in substantially single file.

The microfluidic device further comprises at least one fluid reservoir comprising a fluid for inflation ("inflation fluid") of the droplets flowing through a microfluidic channel. An "inflation fluid", as used herein, is any hydrophilic or hydrophobic phase capable of flowing freely. An inflation fluid may further comprise one or more reagents, reaction components or samples of interest selected from cells (including any eukaryotic or prokaryotic cells, including but not limited to cells selected from humans, animals, plants, fungi, bacteria, viruses, protozoa, yeasts, molds, algae, rickettsia, and prions); proteins, peptides, nucleic acid sequences, oligonucleotide probes, polymerase enzymes, buffers, dNTPs, organic and inorganic chemicals, and fluorescent dyes. An inflation fluid, as used herein, further serves to dilute the species, if any, present and emulsified in the droplet.

Each of the at least one fluid reservoir further comprises at least one inflator, wherein each inflator comprises an inflator nozzle that is connected to and in communication with a microfluidic channel. The region where the inflator nozzle of an inflator is connected to and in communication with a microfluidic channel is referred to as the "inflation interface". A fluid reservoir may further comprise a series of in-line inflators, wherein each inflator comprises an inflator nozzle that is connected to and in communication with microfluidic channel. The microfluidic device of the present invention may comprise any number of fluid reservoirs, wherein one or more fluid reservoirs may comprise any number of inflators, and wherein one or more of the inflators may comprise a member of one or more series of in-line inflators. Moreover, the inflation interface may encompass one or more inflator nozzles from one or more inflators from one or more fluid reservoirs. For example, the microfluidic device may comprise at least one fluid reservoir, wherein each fluid reservoir comprises at least one inflator but preferably more than one inflator, more or less than about 12 inflators, more or less than about 24 inflators, more or less than about 50 inflators, more or less than about 100 inflators, more or less than about 250 inflators, more or less than about 500 inflators, more or less than about 750 inflators, more or less than about 1000 inflators, and so forth in one or more series of in-line inflators.

In one or more embodiments of the present invention, the inflator nozzle of each inflator may be of any shape, including but not limited to, circular, elliptical, triangular, rectangular and so forth. The inflator nozzle may have an average cross-sectional dimension of less than about 100 μm, less than about 10 μm, less than about 1 μm, less than about 100 nm, less than about 10 nm and so forth. The inflator nozzle may be flush with a microfluidic channel or, alternatively, may protrude into a microfluidic channel.

The microfluidic device of the present invention further comprises a mechanism for disrupting at least a portion of the interface between a droplet flowing in a microfluidic channel and a fluid in an inflator, resulting in inflation of a relatively controlled volume of fluid into the droplet and, hence, a respective increase in the volume of the droplet relative to the volume prior to inflation. An "interface", as used herein when referring to the interface between a droplet and a fluid, is one or more regions where two immiscible or partially immiscible phases (e.g., a droplet and a fluid) are capable of interacting with each other. As a droplet passes the inflation interface and the microfluidic channel and upon disruption of the interface between the droplet and the fluid in the inflator, there is a relative flow of fluid from the inflator, via the inflator nozzle, into the droplet. As the droplet continues to flow past the inflation interface, there is a shearing force that breaks the contact between the droplet and the fluid, after which the interface is restored and fluid ceases to flow between the fluid and the droplet, ending droplet inflation.

The volume, direction and rate of fluid inflation may be controlled by adjusting or modifying various factors of the droplets, fluid, and/or microfluidic device components, including but not limited to, the mechanism of disrupting the interface between the droplet and the fluid (discussed further below); the curvature and/or velocity of the droplet; the pressure in the inflator and/or the microfluidic channel relative to one another; the surface tension of the droplet; the surface tension of the fluid; the geometry of the inflator nozzle, inflator and/or microfluidic channel, and so forth as will be known and appreciated by one of skill in the art. The above factors may, in some instances, result in forces acting on the microfluidic device of the present invention, as described below.

For example, the inflator nozzle should be constructed such that the pressure of the microfluidic device may be balanced to substantially prevent the fluid in the inflator from flowing out of the inflator nozzle unless there is a droplet in direct contact with the inflation interface and there is sufficient activation energy to foster inflation of fluid into the droplet. Accordingly, when there is no droplet in direct contact with the inflation interface or, in instances where there is a droplet in direct contact with the inflation interface but there is no mechanism for disrupting the interface between the droplet and fluid, there is substantially no net positive or net negative flow of volume into the droplet because the forces pushing fluid out of the inflator and into the droplet are substantially balanced by the forces pushing fluid out of the droplet and into the inflator. Accordingly, the microfluidic device of the present invention is constructed to substantially prevent dripping of fluid from an inflator into a microfluidic channel when there is no droplet in direct contact with the respective inflation interface or, in instances where there is a droplet in direct contact with an inflation interface but there is no mechanism for disrupting the interface between the droplet.

The mechanism for disrupting the interface between a droplet and a fluid may be selected from any passive or active method, or combinations thereof, known and appreciated by one of skill in the art. Xu, et al., "Droplet Coalescence in Microfluidic Microfluidic devices", *Micro and Nanomicrofluidic devices* (2011) vol. 3, no. 2, pp. 131-136, the entirety of which is incorporated herein by reference, describes many interface disruption mechanisms in the context of droplet coalescence but the same apply for inflation of droplets with multiple substantially controlled volumes of fluid, as will be known, understood and appreciated by one of skill in the art.

Passive methods for disrupting the interface between a droplet and a fluid do not require external energy and rely primarily on the structure and surface properties of the microfluidic channel and associated inflators and respective inflator nozzles. Passive methods for disrupting the interface include, but are not limited to, flow trapping and surface modification, which are further described by Xu, et al. and will be known and appreciated by one of skill in the art.

Examples of passive methods for disrupting the interface between a droplet and a fluid include, but are not limited to, the use of a localized hydrophilic region in a microfluidic channel, wherein the microfluidic channel comprises hydrophobic walls and contains aqueous-based droplets in a continuous oil phase flowing therein. The hydrophobic walls of the microfluidic channel prevent wetting of droplets and promote the presence of a thin layer of the continuous phase between the droplets and the microfluidic channel surface. However, when the microfluidic further comprises a localized region that is relatively hydrophilic, wetting of the droplets occurs as they flow pass this localized region, resulting in disruption of the previously stable interface and inflation of fluid into the droplet. Once the droplets flow past this localized region, the continuous phase will naturally re-wet the microfluidic channel wall and, thus, promote reformation and stabilization of the droplets. A localized hydrophilic region may be created in a hydrophobic microfluidic channel by various methods known and appreciated by one of skill in the art, including but not limited to, constructing the microfluidic channel with a material having surface chemistry that may be initiated with ultraviolet (UV) light, such that shining UV light to the localized region will induce said surface chemistry resulting in a change in the material surface property of the region from relatively hydrophobic to relatively hydrophilic.

Other examples of passive methods for disrupting the interface between a droplet and a fluid include creating posts or other disruptions in the path of the droplet intended to increase the shear forces on the droplet as it passes through a particular region of the microfluidic channel, or, alternatively, incorporating valves into or deformations in the walls of the microfluidic channel to physically trap a droplet to promote destabilization of at least a portion of the interface. Each of these methods results in a relatively unstable interface which, as described above, reforms and stabilizes once the droplet passes the region of disruption.

Active methods for disrupting the interface between a droplet and a fluid require energy generated by an external field. Active methods for disrupting the interface include, but are not limited to, electrocoalescence (i.e., by applying an electric field through the use of, e.g., one or more pairs of electrodes either in contact with the fluids or external to them) and dielectrophoresies (DEP), temperature and pneumatically actuated methods, including the use of lasers and acoustic pressure methods, many of which are described by Xu, et al. and will be known and appreciated by one of skill in the art.

Examples of active methods for disrupting the interface between a droplet and a fluid include, but are not limited to, changing the temperature in a localized region of the microfluidic device, resulting in temperature-dependent viscosity and surface tension changes affecting disruption of the interface between a droplet and a fluid and/or emulsion. For example, a laser may be focused (in the form of a "laser spot") on a region of the microfluidic channel encompassing an inflation interface. Such spatial variation in temperature around the laser spot will promote spatial imbalance of droplet surface tension, resulting in a thermocapillary effect on and, hence, destabilizing of, the interface. In another example, acoustic pressure waves may be used to disrupt the surface of a droplet, change the wettability of a droplet or manipulate the position of a droplet. As with methods discussed previously, each of these methods results in a relatively unstable interface which, as described above, reforms and stabilizes once the droplet passes the region of disruption.

In one or more embodiments of the present invention, the mechanism for disrupting the interface between a droplet and a fluid is selected from at least one pair of electrodes. In such embodiments, the at least one pair of electrodes may be positioned substantially orthogonal to the microfluidic channel. In some aspects of one or more embodiments, the at least one pair of electrodes may be positioned substantially opposite to one or more inflator. The at least one pair of electrodes applies an electric field to one or more inflation interface. In some examples, the at least one pair of electrodes may be positioned such that the electrodes create an electric field maximally located within one or more inflation interface or at least proximate to the inflation interface.

In embodiments wherein at least one pair of electrodes is utilized as a mechanism for disrupting the interface between a droplet and a fluid as described above, the electrodes may be positioned in a variety of configurations relative to other components of the microfluidic device. For example, a first electrode and a second electrode of at least one pair of electrodes may be positioned above or below the microfluidic channel. In some instances, a first electrode and a second electrode of at least one pair of electrodes may be positioned essentially on opposite sides of the microfluidic channel. In other instances, a first electrode and a second electrode of at least one pair of electrodes may be positioned essentially on opposite sides of both the microfluidic channel and one or more inflators. In yet other instances, a first electrode and a second electrode of at least one pair of electrodes may be positioned such that a plane intersects both electrodes. In still other instances, a first electrode and a second electrode of at least one pair of electrodes may be positioned to be co-planar with the microfluidic channel and/or co-planar with one or more inflator and/or co-planar with one or more inflator nozzle, such that the electrodes are positioned such that a plane intersects with each of these. In still another aspect of this embodiment, only one of the electrodes in a particular pair of electrodes needs to be localized. For example, a large ground plane may serve many individual, localized electrodes. In another example, a continuous phase fluid (which may or may not be the fluid in the inflation channel) may serve as one of the electrodes in a pair.

The electrodes may be fabricated from any suitable material, which will be understood and appreciated by one of skill in the art. For example, the electrodes may be fabricated from materials including, but not limited to, metals, metalloids, semiconductors, graphite, conducting polymers, and liquids, including but not limited to ionic solutions, conductive suspensions, liquid metals, and so forth. The electrodes may have any shape suitable for applying an electric field, as will be understood and appreciated by one of skill in the art. For example, an electrode may have an essentially rectangular shape. In this example, the electrode may be elongated and have a tip defined as a region of the electrode closest to an inflation interface. The electrode tip is constructed such that a sufficient electric field is created in said intersection or substantially proximate to an inflation interface as described previously.

In some examples where more than one pair of electrodes is employed, the electrodes may be constructed to minimize interference between one or more electrodes and one or more inflators, for example, by minimizing the unintended exposure of a first interface to an electric field by an electrode intended to expose a second interface positioned in a different location than the first interface to an electric field. In some aspects, this may be accomplished by reducing the size of the electrode tip to allow more focused application of an electric field by the electrode tip such that one or more interfaces are not unintentionally exposed to the electric field, and/or are exposed to relatively lower electric field strengths. In other aspects, the region comprising an inflator and respective inflator nozzle may be modified, e.g., by adding dimension in the form of a small bump or other modification for the purpose of localizing and strengthening the electric field in that around an inflation interface. Such aspects of the present invention may be advantageous, for example, in instances where it is desired to reduce the distance between multiple microfluidic channels, each associated with multiple inflators and respective inflator nozzles as part of a microfluidic device.

As a droplet flows through a microfluidic channel it encounters each inflation interface. Upon encountering an inflation interface, together with an operating mechanism for disrupting the interface between a droplet and a fluid, a substantially controlled volume of fluid is inflated into the droplet. As the droplet passes the inflation interface, the inflation fluid is sheared off and the interface between the droplet and the inflation fluid is reformed, resulting in the formation of a relatively larger droplet, which continues to flow through the microfluidic channel, encountering one or more additional inflation interfaces and being inflated with additional fluid in a successive, sequential manner as described immediately above. In one embodiment, a droplet may be in contact with more than one inflation interface at or about the same time, such that the droplet is inflated with fluid from more than one inflator at approximately or substantially the same time. Whether a droplet is inflated successively or simultaneously or a combination thereof, as the droplet is inflated multiple times, the volume of the droplet grows larger. Accordingly, the microfluidic channel is constructed such that its size (or diameter) enlarges to allow the droplet to remain intact as it flows through the microfluidic channel.

In one or more embodiments of the present invention, the volume of fluid inflated into a droplet from each inflator may be any suitable amount, depending on the embodiment, as will be appreciated and understood by one of skill in the art. For example, the initial volume of a droplet may be less than about 10 μL, less than about 1 μL, less than about 100 nL, less than about 10 nL, less than about 1 nL, less than about 100 pL, less than about 10 pL, less than about 1 pL, less than about 100 fL, less than about 10 fL, less than about 1 fL and so forth, whereas the inflation volume into a droplet from any particular inflator or from one or more inflators may be about 1×, about 10×, about 100×, about 1,000×, about 10,000× times and so forth, the initial volume of the droplet.

A wide variety of methods and materials exists and will be known and appreciated by one of skill in the art for construction of the microfluidic device of the present invention, such as those described, for example, in U.S. Pat. No. 8,047,829 and U.S. Patent Application Publication No. 20080014589, each of which is incorporated herein by reference in its entirety. For example, the components of the microfluidic device may be constructed using simple tubing, but may further involve sealing the surface of one slab comprising open channels to a second flat slab. Materials into which the components of the microfluidic device may be formed include silicon, glass, silicones such as polydimethylsiloxane (PDMS), and plastics such as poly(methylmethacrylate) (known as PMMA or "acrylic"), cyclic olefin polymer (COP), and cyclic olefin copolymer (COC). The same materials can also be used for the second sealing slab. Compatible combinations of materials for the two slabs depend on the method employed to seal them together. The microfluidic channel may be encased as necessary in an optically clear material to allow for optical detection of spectroscopic properties of the droplets flowing through the microfluidic channel. Preferred examples of such optically clear materials that exhibit high optical clarity and low autofluorescence include, but are not limited to, borosilicate glass (e.g., SCHOTT BOROFLOAT® glass (Schott North America, Elmsford N.Y.)) and cyclo-olefin polymers (COP) (e.g., ZEONOR® (Zeon Chemicals LP, Louisville Ky.)).

Figure 1B:
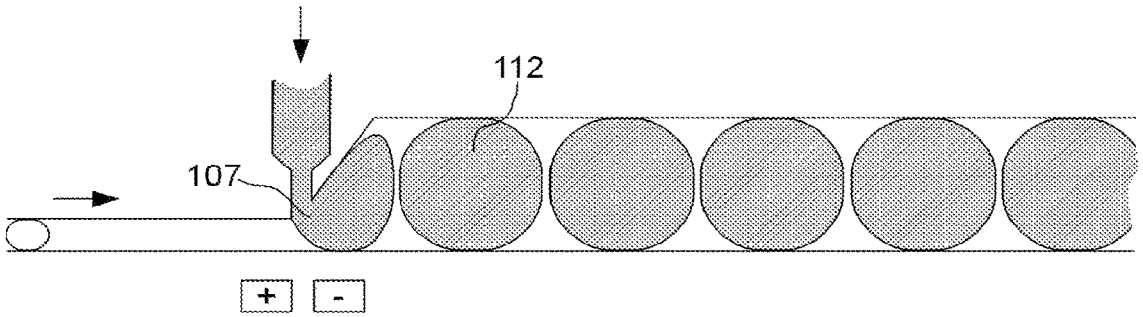

FIGS. 1A-B illustrate an example of one embodiment of a microfluidic device for performing droplet inflation according to the present invention, comprising a single pair of electrodes and an inflator comprising a single inflator nozzle. The microfluidic device 100 of FIGS. 1A-B comprises a microfluidic channel 102, in which a relatively small droplet 101 flows. The size (or diameter) of the microfluidic channel 102 is sufficiently narrow such that the droplet 101 flows through the microfluidic channel 102 in substantially single file form together with other droplets (not shown) in the microfluidic channel 102. The microfluidic device 100 further comprises an inflator 106, which connects a fluid reservoir (not shown) comprising inflation fluid (not shown) with the microfluidic channel 102 via an inflator nozzle 103. Accordingly, the microfluidic device 100 provides inflation of the droplet 101 in the direction indicated.

The microfluidic channel 102 has a region of expansion 105 that occurs at or near the inflator nozzle 103 in order to allow for the formation of relatively larger droplets 112 as a result of inflation of the droplet 101 and other droplets (not shown) flowing in the microfluidic channel 102. The inflator nozzle 103 is open and allows the inflation fluid (not shown) in the fluid reservoir (not shown) to communicate with the microfluidic channel 102 in a region referred to as the inflation interface 104. The pressure of the inflation fluid is substantially balanced with the pressure of the microfluidic channel 102 and the surface tension at the inflator nozzle 103 such that when the droplet 101 (and other droplets not shown) is not in contact with the inflator nozzle 103, the pressure at the inflation interface 104 is substantially balanced such that inflation fluid does not drip or flow into the microfluidic channel 102.

The microfluidic device 100 further comprises a pair of electrodes 109-110 as the mechanism for disruption of the interface between a droplet and the inflation fluid. However, any other such mechanism described above and known and appreciated by one of skill in the art may be used in place of a pair of electrodes 109-110 in this example and any other embodiment of the present invention described herein. In this example, the pair of electrodes 109-110 comprises a positive electrode 109 and a negative electrode 110 arranged on substantially the same side of the microfluidic channel 102 and substantially opposite to the inflator 106. When there is no droplet present at an inflation interface (as illustrated by way of example at inflation interface 104), the inflation fluid in the inflator 106 and inflator nozzle 103 remains there and does not flow into the microfluidic channel 102. As further illustrated in FIG. 1B, as the droplet 101 contacts the inflation interface 104 associated with inflator nozzle 103, the inflation fluid is inflated into droplet 101 at the nozzle margin 107. As droplet 101 flows past the inflation interface 104 and is subject to the electric field produced by the pair of electrodes 109-110, the inflation fluid being inflated into the droplet is sheared off from the inflation fluid in the inflator 106, followed by restoration of the inflation interface 104.

Figure 2:
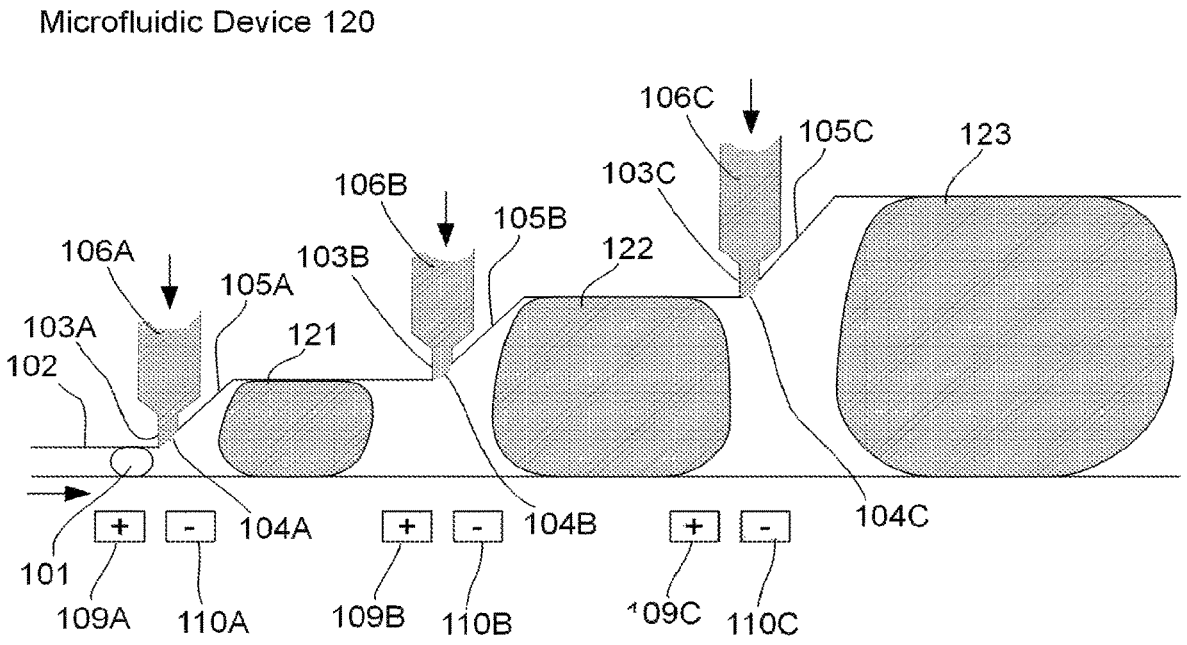
FIG. 2 illustrates an example of an embodiment of a microfluidic device for performing droplet inflation comprising a series of inflators, wherein each inflator comprises a single inflator nozzle and is associated with its own pair of electrodes, according to the present invention.

FIG. 2 illustrates an example of an embodiment of a microfluidic device for performing droplet inflation comprising a series of inflators, wherein each inflator comprises a single inflator nozzle and is associated with its own pair of electrodes, according to the present invention. The microfluidic device 120 in FIG. 2 shows three single inflator nozzles (103A, 103B, 103C) and corresponding inflators (106A, 106B, 106C which may contain the same or different reagents) coupled in series. In this example, a droplet 101 (and other droplets not shown) is inflated via inflator nozzle 103A of inflator 106A at inflation interface 104A, resulting in droplet 121, which continues to flow through the microfluidic channel 102 and undergo subsequent inflations via sequential inflation interfaces (104B and 104C, respectively). As such, droplet 101 is successively inflated relatively larger each time as illustrated by resulting droplets 121, 122 and 123. The microfluidic channel 102 geometry (105A, 105B, 105C) and placement of electrodes (109-110A, 109-110B, 109-110C), of microfluidic device 120 follow similar designs to the microfluidic device 100 illustrated previously. Further in this example, a pair of electrodes, each comprising a positive electrode (109A, 109B, 109C) and a negative electrode (110A, 110B, 110C), is positioned on substantially the same side of the microfluidic channel 102 and substantially opposite to the respective inflator nozzle (103A, 103B, 103C). In addition, the inflators (106A, 106B, 106C) are positioned just before a stepwise graduation in channel diameter (105A, 105B, 105C) as to allow the drop to flow within the channel 102. The inflation fluid that feeds into the inflator nozzles (103A, 103B, 103C) from the inflators (106A, 106B, 106C) may be provided by the same fluid reservoir or independent fluid reservoirs (not shown).

Figure 3A:
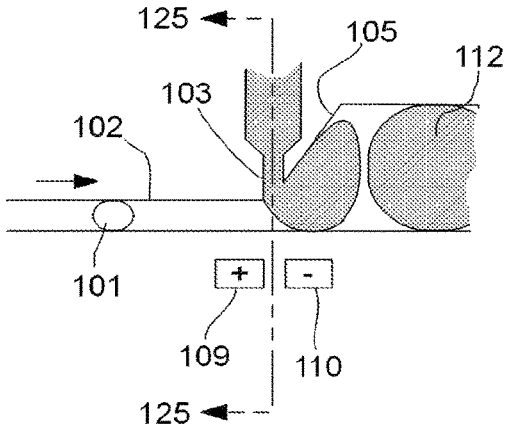
FIGS. 3A-D illustrate examples of various aspects of an embodiment of a microfluidic device for droplet inflation, demonstrating cross-section geometries and different positioning of the inflator nozzle relative to the microfluidic channel, according to the present invention.
Figure 3B:
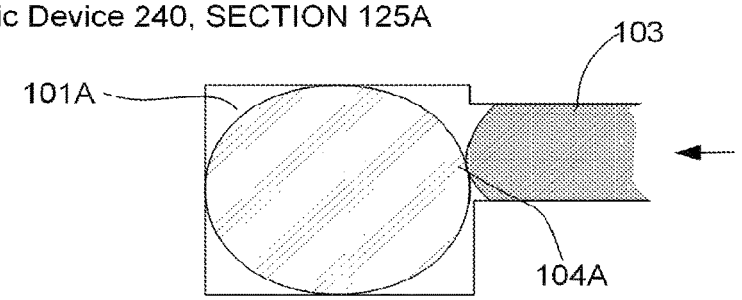
Figure 3C:
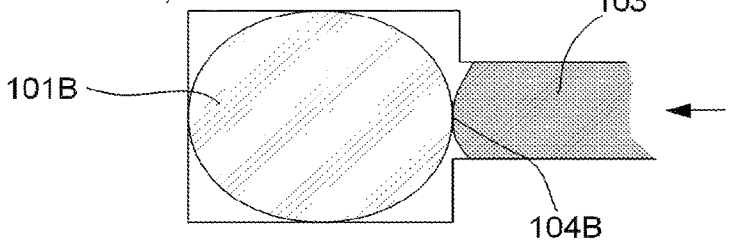
Figure 3D:
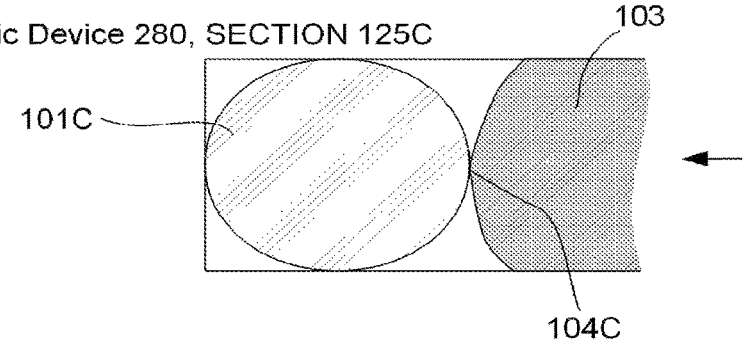

FIGS. 3A-D illustrate examples of various aspects of an embodiment of a microfluidic device for droplet inflation, demonstrating cross-section geometries and different positioning of an inflator nozzle relative to a microfluidic channel, according to the present invention. Accordingly, FIGS. 3A-D illustrate different configurations of the intersection of the inflator nozzle 103 with the microfluidic channel 102 in a microfluidic device. Specifically, FIG. 3A illustrates microfluidic device 220 having a cross-section 125 through the inflator nozzle 103 and the microfluidic channel 102. FIG. 3B illustrates a cross-section 125A of the microfluidic device 240 with the inflator nozzle 103 being about half the height of the microfluidic channel 102 and positioned at the bottom with respect to the microfluidic channel 102 and with the inflation interface 104A being in contact with the approximate bottom half of a droplet 101A. FIG. 3C illustrates a cross-section 125B of the microfluidic device 260 with the inflator nozzle 103 being about half the height of the microfluidic channel 102 and positioned in approximately the center of the microfluidic channel 102 and with the inflation interface 104B being in contact with the approximate center of a droplet 101B. FIG. 3D illustrates a cross-section 125C of one configuration of microfluidic device 280 with the inflator nozzle 103 being approximately the same height as the microfluidic channel 102 and positioned such that the inflation interface 104C is in approximate contact with a droplet 101C.

FIGS. 4A-4D illustrate examples of various aspects of an embodiment of a microfluidic device for performing droplet inflation, demonstrating the different positions and angles of the inflator nozzle 103 and its inflator 106 relative to the microfluidic channel 102, together with a pair of electrodes 109-110 as an example of a method for disrupting the interface between a droplet and a fluid, according to the present invention. FIGS. 4A-4D further illustrate an area of expansion 105 of the microfluidic channel 102 to accommodate inflated droplets (e.g., inflated droplet 112 corresponding to original droplet 101 in this example). These different geometric conditions may be desirable under different target inflation volumes and/or to allow flexibility in the control of inflation.

Figure 4A:
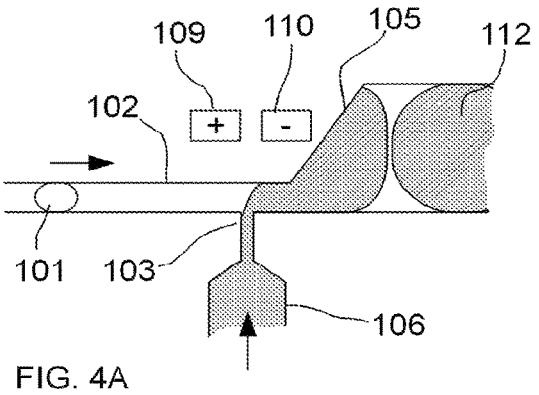
FIGS. 4A-D illustrate examples of various aspects of an embodiment of a microfluidic device for performing droplet inflation, demonstrating different positions and angles of the inflator nozzle relative to the microfluidic channel, according to the present invention.
Figure 4B:
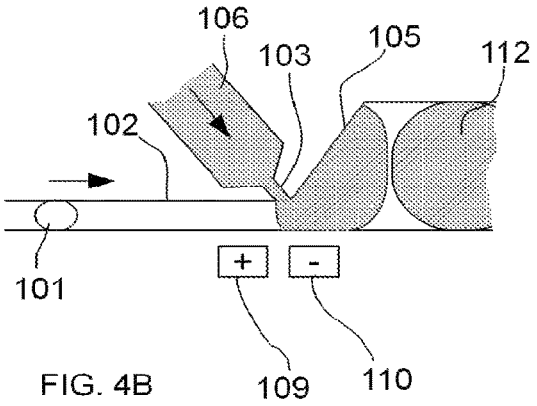
Figure 4C:
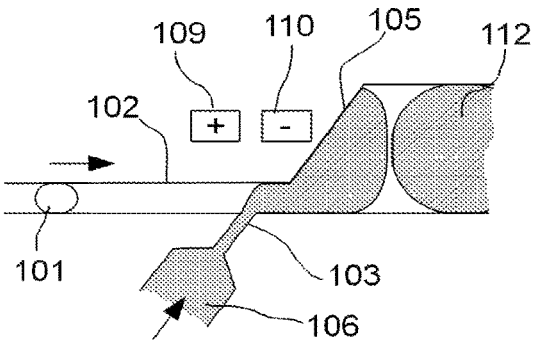
Figure 4D:
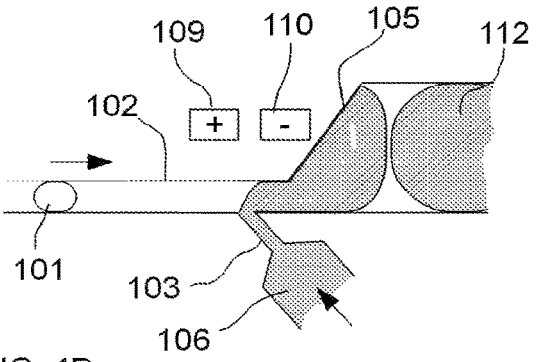

FIG. 4A illustrates one configuration wherein the inflator nozzle 103 is positioned approximately perpendicular to the microfluidic channel 102 and approximately opposite to the area of expansion 105. FIG. 4B illustrates another configuration wherein the inflator nozzle 103 is positioned at an approximately acute angle with respect to the microfluidic channel 102 and on the same side and abreast of the area of expansion 105. FIG. 4C illustrates yet another configuration wherein the inflator nozzle 103 is positioned at an approximately acute angle with respect to the microfluidic channel 102 and approximately opposite to the area of expansion 105. FIG. 4D illustrates still another configuration wherein the inflator nozzle 103 is positioned at an approximately reverse acute angle compared to that illustrated in FIG. 4C.

Figure 5A:
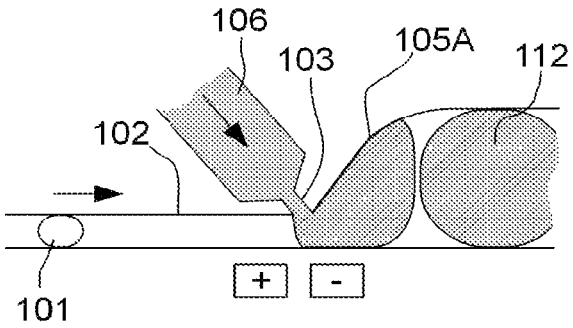
FIGS. 5A-C illustrate an example of an embodiment of a microfluidic device for performing droplet inflation, demonstrating expansion of the microfluidic channel to accommodate inflation of a droplet, wherein the expansion may take the form of various shapes, e.g., symmetrical, asymmetrical, linear, sloped, or exponential in scale, according to the present invention.
Figure 5B:
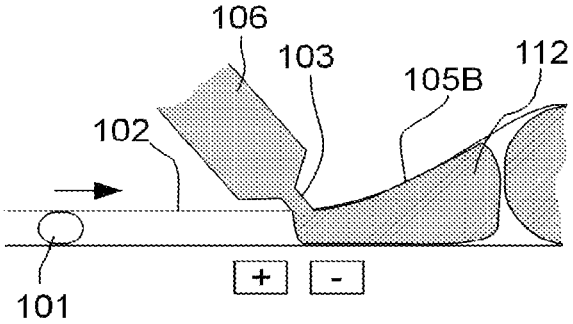
Figure 5C:
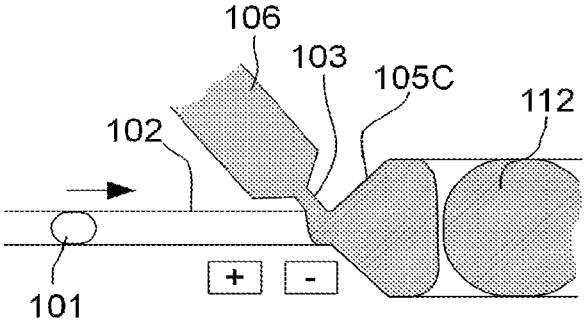

FIGS. 5A-5C illustrate an example of an embodiment of a microfluidic device for performing droplet inflation, demonstrating expansion of the microfluidic channel to accommodate inflation of a droplet, wherein the expansion may take the form of various shapes, e.g., symmetrical, asymmetrical, linear, sloped, or exponential in scale, according to the present invention. Specifically, FIGS. 5A-5C illustrate different geometric configurations for the area of expansion (105A, 105B and 105C, respectively) of the microfluidic channel 102 to accommodate inflation of a droplet 101 with fluid from an inflator 106 via an inflator nozzle 103 to form a relatively larger droplet 112. These different geometric conditions may be desirable under different target inflation volumes and/or to allow flexibility in the control of inflation.

FIG. 5A illustrates one configuration wherein the area of expansion 105A follows a profile such that the expansion in the cross-sectional area of the microfluidic channel 102 occurs more dramatically at first and then tapers off. FIG. 5B illustrates another configuration wherein the area of expansion 105B follows a profile such that the expansion in the cross-sectional area of the microfluidic channel 102 occurs more gradually at first and then more significantly. FIG. 5C illustrates yet another configuration wherein the area of expansion 105C occurs on both sides of the microfluidic channel 102 and follows a profile such that the expansion in the cross-sectional area of the microfluidic channel 102 occurs approximately equally throughout the length of the expansion.

Figure 6A:
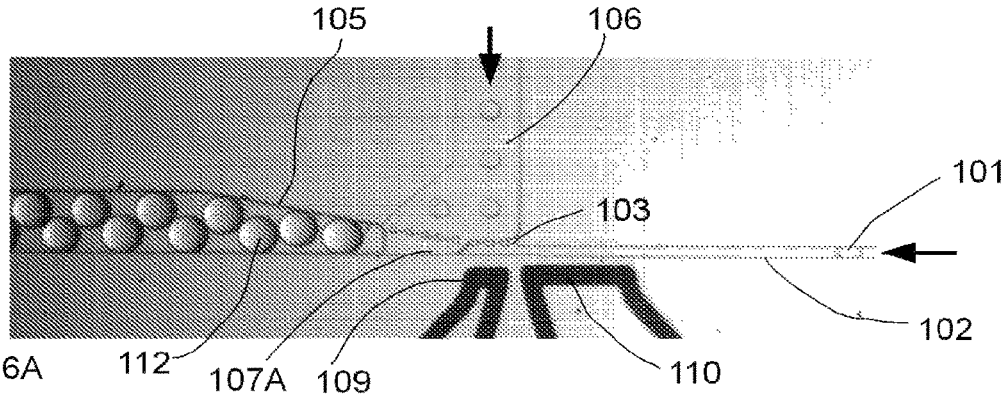
FIGS. 6A-C are micrographs of an embodiment of a microfluidic device for performing droplet inflation, comprising a single inflator with multiple nozzles and a single electrode pair, according to the present invention.
Figure 6B:
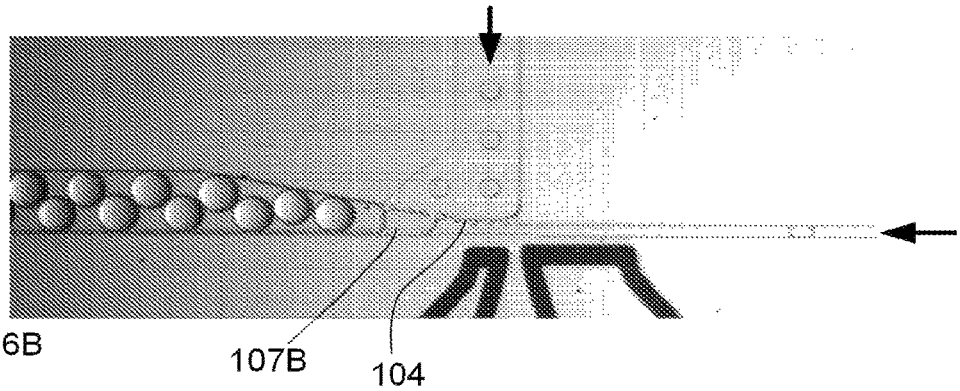
Figure 6C:
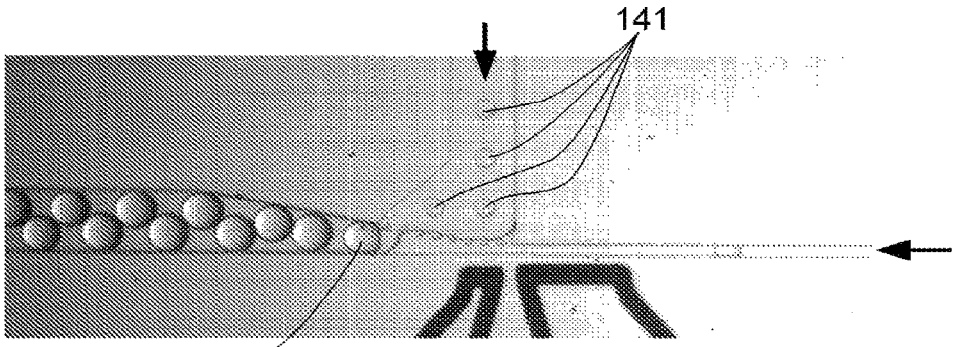

FIGS. 6A-6C are micrographs of an embodiment of a microfluidic device for performing droplet inflation, comprising a single inflator with multiple nozzles and a single pair of electrodes as a method for disrupting the interface between a droplet and a fluid, according to the present invention. Specifically, FIGS. 6A-C comprise a time-series of micrographs showing the inflation of droplets (illustrated by exemplary droplet 101 inflated to form resulting droplet 112) by a microfluidic device 140. The inflation fluid is fed from one inflator 106 into several inflator nozzles (103, collectively) to form an inflation interface 104 with a microfluidic channel 102. As a droplet passes each inflator nozzle 103, inflation fluid (illustrated collectively as 141) is introduced and then sheared off in a successive manner as the droplet grows in size (this process is illustrated as 107A, 107B and 107C, respectively) at the inflation interface 104.

Figure 7:
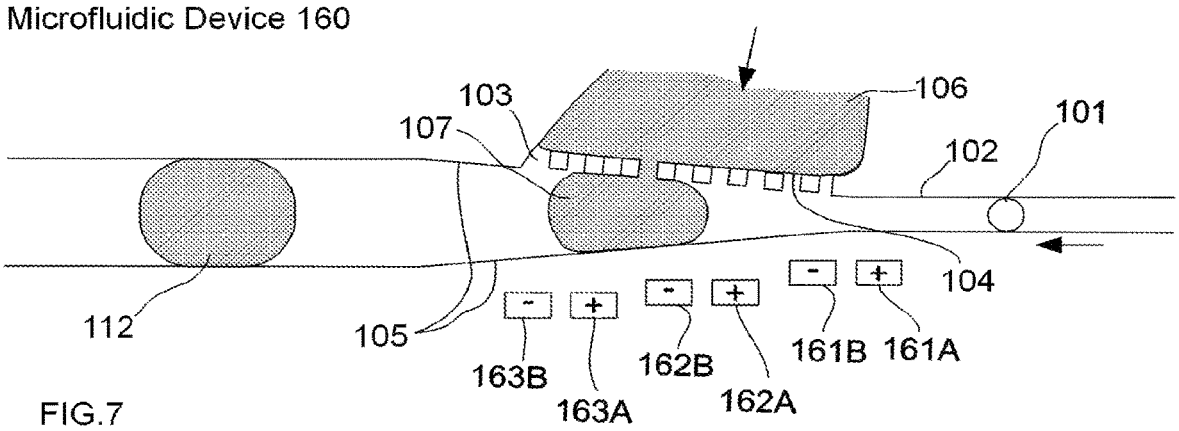
FIG. 7 illustrates an example of an embodiment of a microfluidic device for performing droplet inflation, comprising a single inflator comprising multiple inflator nozzles, and wherein multiple electrode pairs are utilized to create a larger electric field, according to the present invention.

FIG. 7 illustrates an example of an embodiment of a microfluidic device for performing droplet inflation, comprising a single inflator comprising multiple inflator nozzles, and wherein multiple electrode pairs are utilized to create a larger electric field, according to the present invention. Specifically, FIG. 7 illustrates a microfluidic device 160 comprising an example of one configuration for an inflator 106 comprising multiple inflator nozzles (illustrated as 103, collectively). In this example, multiple electrode pairs (161A, 161B, 162A, 162B, 163A, and 163B) are used to expand the electric field and provide for disruption of the interface between a droplet and a fluid at each inflation interface (illustrated collectively as 104).

Figure 8A:
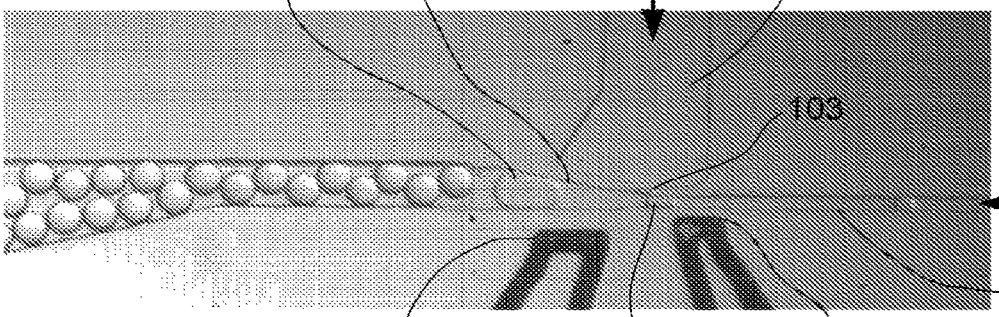
FIGS. 8A-C are time-series micrographs of an embodiment of a microfluidic device comprising a single inflator with a single inflator nozzle, and a single electrode pair, in operation performing droplet inflation according to the present invention.
Figure 8B:
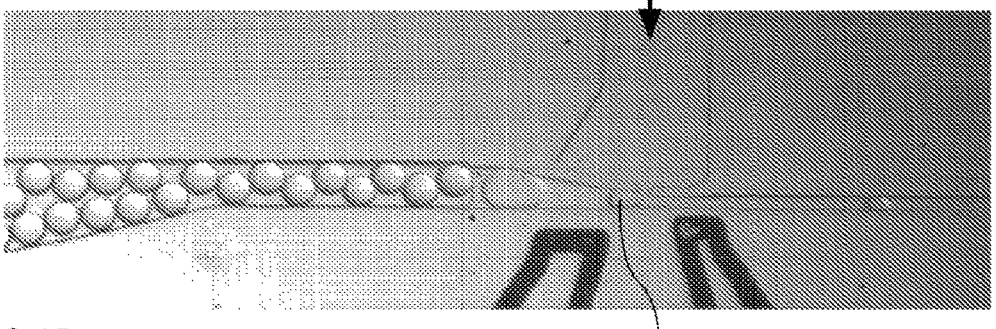
Figure 8C:
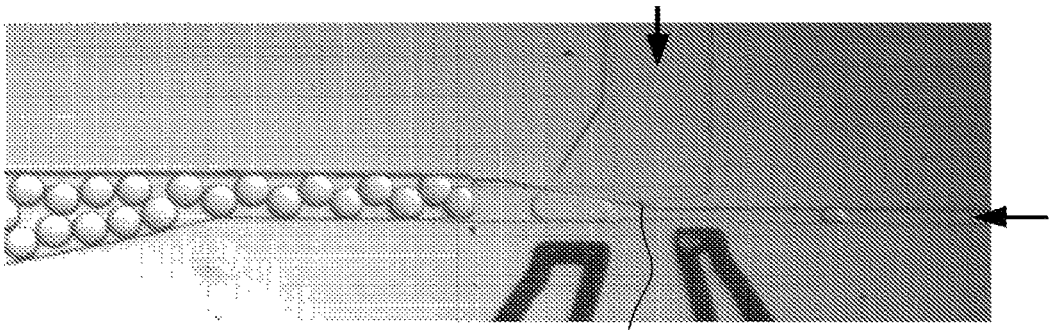
Figure 8D:
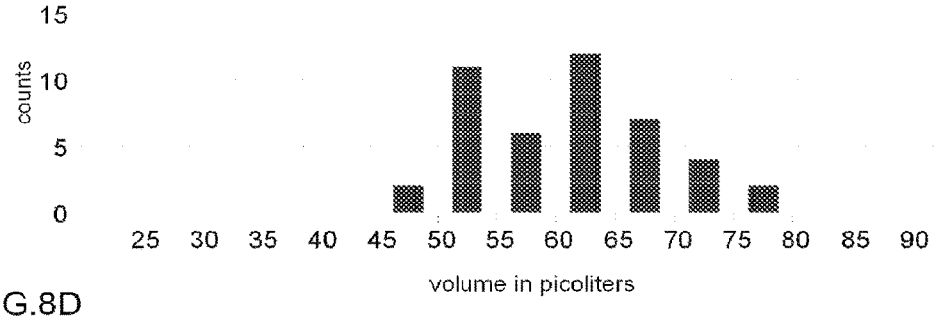
FIG. 8D is a graph showing the distribution of volume inflated into the droplets in the operation of this microfluidic device.

FIGS. 8A-8C are a time-series of micrographs of an embodiment of a microfluidic device 180 comprising a single inflator 106 having a single inflator nozzle 103, and a single electrode pair 109-110, in operation performing droplet inflation according to the present invention. FIG. 8D is a histogram plot showing the distribution of volume inflated into the droplets in the operation of the microfluidic device 180. For example, the graph shows that just over 10 droplets ("counts") were inflated with between 50 and 55 pL of a given sample.

Figure 9A:
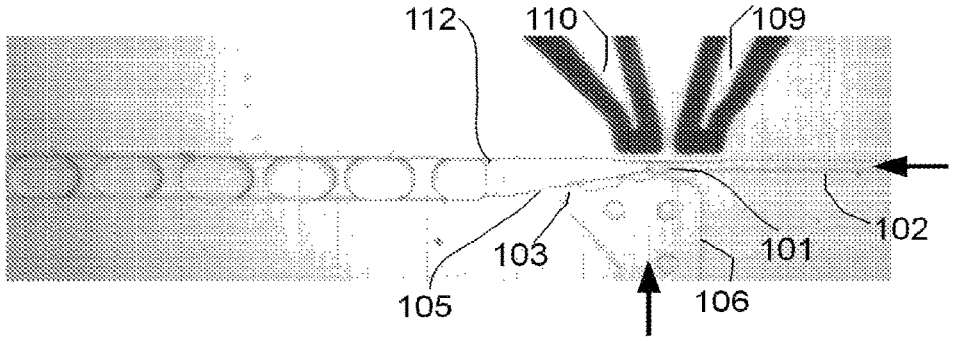
FIGS. 9A-C are time-series micrographs of an example of one embodiment of a microfluidic device comprising a single inflator with multiple inflator nozzles for performing droplet inflation, according to the present invention.
Figure 9B:
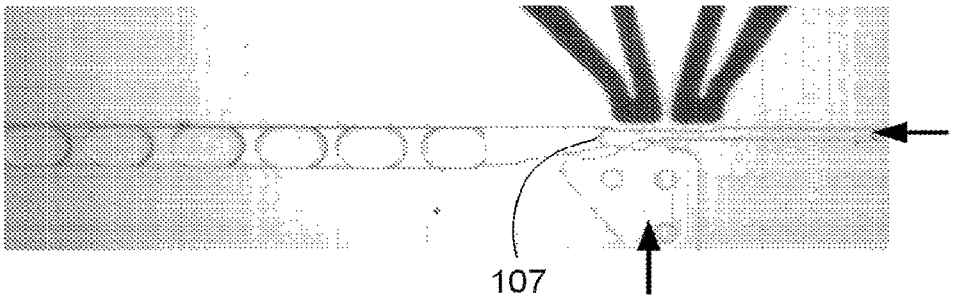
Figure 9C:
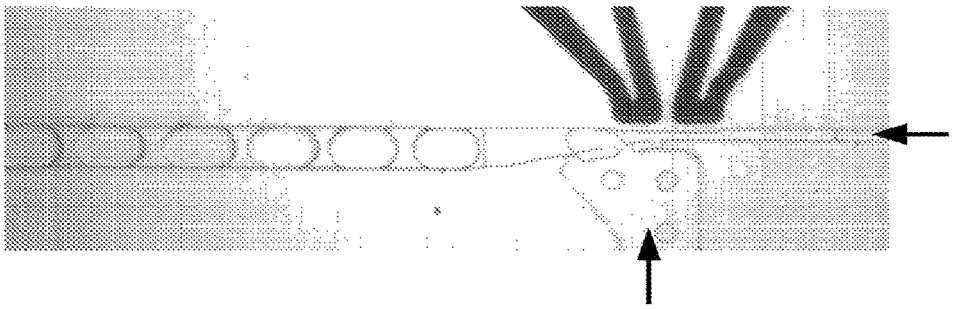

FIGS. 9A-9C are a time-series of micrographs of an embodiment of a microfluidic device 200 comprising a single inflator 106 having multiple inflator nozzles (illustrated collectively as 103), and a single electrode pair

Figure 9D:
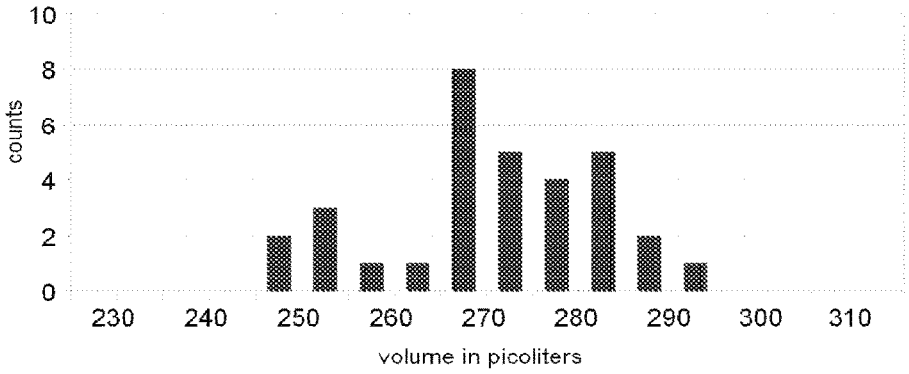
FIG. 9D is a graph showing the distribution of volume inflated into the droplets in the operation of this microfluidic device.

109-110, in operation performing droplet inflation according to the present invention. FIG. 9D is a graph showing the distribution of volume inflated into the droplets in the operation of this microfluidic device. For example, the graph shows that approximately 8 droplets were inflated with between 265-270 pL of a given sample.

The results of the methods of this invention, referred to herein as "data", associated with a particular target nucleic acid sequence or PCR product may then be kept in an accessible database, and may or may not be associated with other data from that particular human or animal associated with the target nucleic acid sequence or with data from other humans or animals. Data obtained may be stored in a database that can be integrated or associated with and/or cross-matched to other databases.

The methods and kits of this invention may further be associated with a network interface. The term "network interface" is defined herein to include any person or computer microfluidic device capable of accessing data, depositing data, combining data, analyzing data, searching data, transmitting data or storing data. The term is broadly defined to be a person analyzing the data, the electronic hardware and software microfluidic devices used in the analysis, the databases storing the data analysis, and any storage media capable of storing the data. Non-limiting examples of network interfaces include people, automated laboratory equipment, computers and computer networks, data storage devices such as, but not limited to, disks, hard drives or memory chips.

Although the present invention and its advantages have been described in detail, it should be understood that various changes, substitutions and alterations can be made herein without departing from the spirit and scope of the invention as defined in the appended claims.

Having thus described in detail preferred embodiments of the present invention, it is to be understood that the invention defined by the above paragraphs is not to be limited to particular details set forth in the above description as many apparent variations thereof are possible without departing from the spirit or scope of the present invention.

What is claimed is:

1. A system for performing droplet inflation, comprising at least one microfluidic channel;

a series of inflators, wherein each inflator comprises at least one inflator nozzle at an inflation interface associated with a location on the microfluidic channel and is associated with a different pair of electrodes, wherein a first inflator in the series is located at a first location on the microchannel wherein said first location comprises a first region of expansion at the inflation interfaces such that a cross-sectional area of the microfluidic channel at the inflation interface expands to accommodate inflated droplets; and a second inflator in the series is located at a second location on the microchannel wherein said second location comprises a second region of expansion at the inflation interfaces such that a cross-sectional area of the microfluidic channel at the inflation interface expands to accommodate inflated droplets.

2. The system of claim 1, wherein at least one side of the microfluidic channel comprises a region of expansion at the inflation interface such that a cross-sectional area of the microfluidic channel at the inflation interface expands to accommodate inflated droplets.

3. The system of claim 1, wherein the first inflator has only one nozzle that forms one inflation interface with the microfluidic channel.

4. The system of claim 1, wherein the first inflator has more than one nozzle, forming more than one inflation interfaces with the microfluidic channel.

5. The system of claim 1, further comprising a third inflator in the series is located at a third location on the microchannel wherein said third location comprises a third region of expansion at the inflation interfaces such that a cross-sectional area of the microfluidic channel at the inflation interface expands to accommodate inflated droplets.

6. The system of claim 1, wherein the first inflator and the second inflator contain different reagents.

7. The system of claim 1, wherein the first inflator and the second inflator contain the same reagents.

8. The system of claim 1, wherein inflation fluid that feeds into the inflator nozzles of the first inflator and the second inflator is provided by the same fluid reservoir.

9. The system of claim 1, wherein inflation fluid that feeds into the inflator nozzles of the first inflator and the second inflator is provided by independent fluid reservoirs.

10. A method of performing droplet inflation with the system according to claim 1, the method comprising, inflating a droplet in the microfluidic channel with fluid from the first inflator and subsequently further inflating the droplet with fluid from the second inflator.

11. The method of claim 10, wherein the droplet is inflated by the first inflator or the second inflator with a volume of the fluid that is at least the volume of the droplet such that the volume of the droplet is at least doubled.

* * * * *